US005454179A

United States Patent [19]

Bulka

[11] Patent Number: 5,454,179

[45] Date of Patent: Oct. 3, 1995

[54] CASSETTE DISPLAY FRAME

[76] Inventor: David B. Bulka, 14 Coolidge Ave., West Caldwell, N.J. 07006

[21] Appl. No.: 249,727

[22] Filed: May 26, 1994

[51] Int. Cl.[6] ..... A47G 1/06

[52] U.S. Cl. ..... 40/152; 40/152.1; 40/158.1

[58] Field of Search ..... 40/152, 152.1, 40/158.1, 156, 160, 574

[56] References Cited

U.S. PATENT DOCUMENTS

| | | | |
|---|---|---|---|
| 3,503,147 | 3/1970 | Henrin et al. | 40/160 |
| 4,117,613 | 10/1978 | Hosker | 40/158.1 X |
| 4,158,266 | 6/1979 | Gilmour | 40/152 X |
| 4,165,408 | 8/1979 | Pierce | 40/158.1 X |
| 4,856,213 | 8/1989 | Hord | 40/152 |
| 4,899,879 | 2/1990 | Rosen | 40/158.1 X |
| 4,953,780 | 9/1990 | Ross | 40/158.1 X |
| 5,096,752 | 3/1992 | Wagner | 40/158.1 X |
| 5,245,775 | 9/1993 | Goserud | 40/158.1 X |
| 5,335,433 | 8/1994 | Borden | 40/152 X |

*Primary Examiner*—Kenneth J. Dorner
*Assistant Examiner*—James O. Hansen
*Attorney, Agent, or Firm*—Young, MacFarlane & Wood

[57] ABSTRACT

A frame for the display of a video cassette, audio cassette, or other similar item such as a compact disc.

8 Claims, 6 Drawing Sheets

CASSETTE DISPLAY FRAME

BACKGROUND OF THE INVENTION

1. Field of the Invention

This invention relates generally to the field of frames and more particularly to a frame for the display of a cassette or other similar item such as a compact disc.

2. Description of the Related Prior Art

Special events such as weddings, anniversaries, concerts, sporting events, or lectures are often recorded on video cassettes or audio cassettes or the like. It is desireable to display and protect favorite cassettes in an aesthetically-pleasing way to commemorate the event and to prevent the cassette from being lost, forgotten, or damaged.

It is known in the prior art to store video cassettes with picture frames displaying photographs commemorating the same event. For example, U.S. Pat. No. 4,856,213 to Hord teaches a combination picture frame and video cassette holder. However, unlike the present invention, the Hord frame conceals the video cassette when the frame is viewed from the front. On the contrary, a primary object of the present invention is to display the cassette itself in an attractive manner when the frame is viewed from the front.

SUMMARY OF THE INVENTION

Disclosed and claimed herein is a cassette display frame comprising a front frame member having a top portion, a bottom portion, and two opposed side portions which are joined together to form a frame around a cassette-viewing opening. The front frame member further defines a cavity which has a depth at least sufficient to contain a cassette therein. A transparent panel is positioned over the cassette-viewing opening within the cavity. A frame backing member having a front surface, a back surface, and a perimeter approximately the same size as the front frame member is secured to the front frame member behind and parallel to the transparent panel. The frame backing member has a cassette retention means to releasably hold a cassette in place on the front surface of the frame backing member such that the cassette is visible through the transparent panel over the cassette-viewing opening.

The frame backing member may be secured to the front frame member by slidably inserting the edges of the frame backing member into grooves in the cavity of the front frame member. Alternatively, fastening means such as adhesives, rotatable tabs, staples, or screws may be used to attach the frame backing member to the front frame member.

The cassette display frame may further include one or more decorative mats between the front surface of the frame backing member and the transparent panel. Wall-hanging means or table-top support means may also be affixed to the back surface of the frame backing member.

BRIEF DESCRIPTION OF THE DRAWINGS

Other objects and advantages of the invention will become apparent upon reading the following detailed description and upon reference to the drawings, in which.

DETAILED DESCRIPTION OF THE INVENTION

Figure 1:
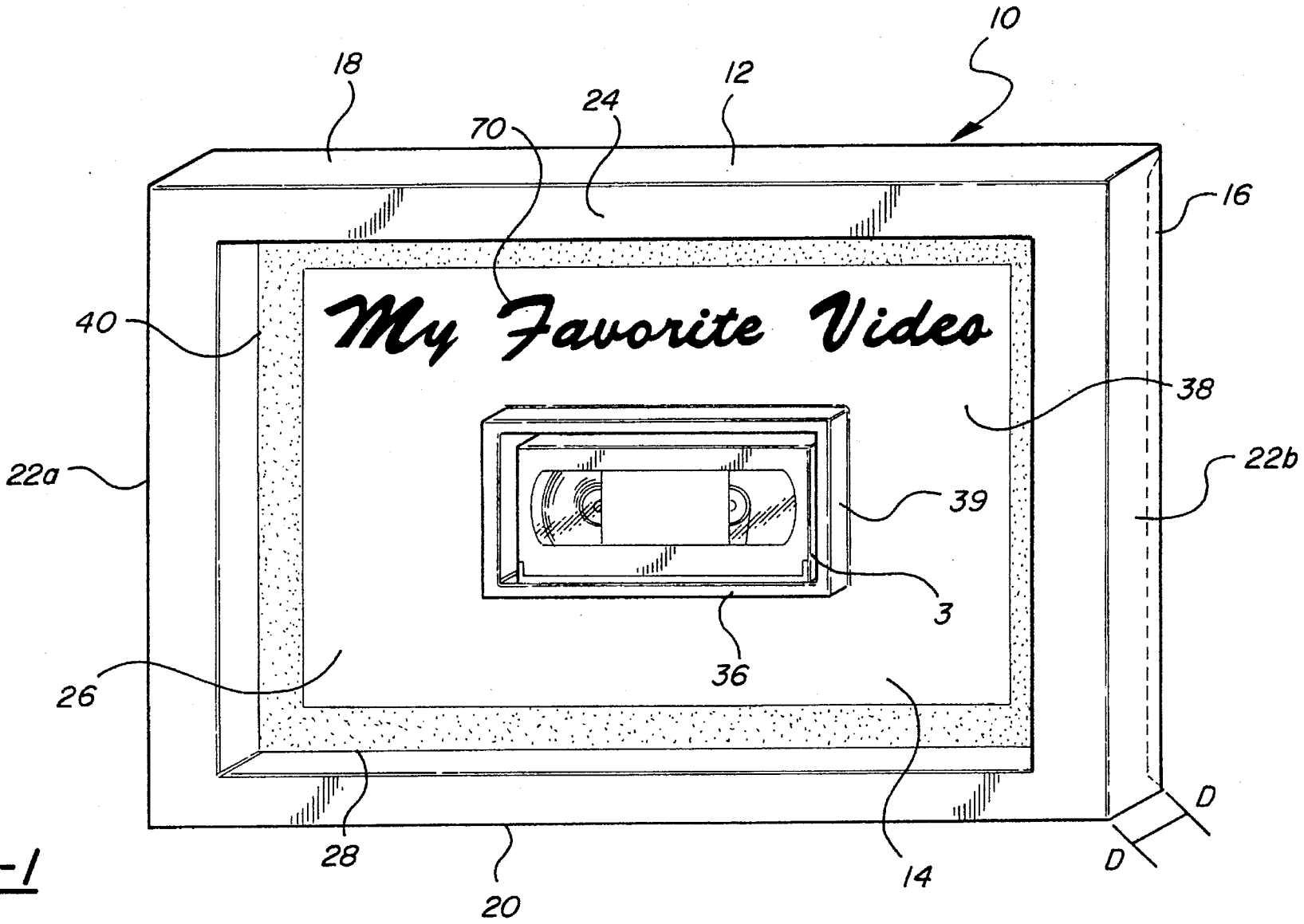
FIG. 1 is a front perspective view of an embodiment of a cassette display frame constructed in accord with the teachings of the present invention.
Figure 2:
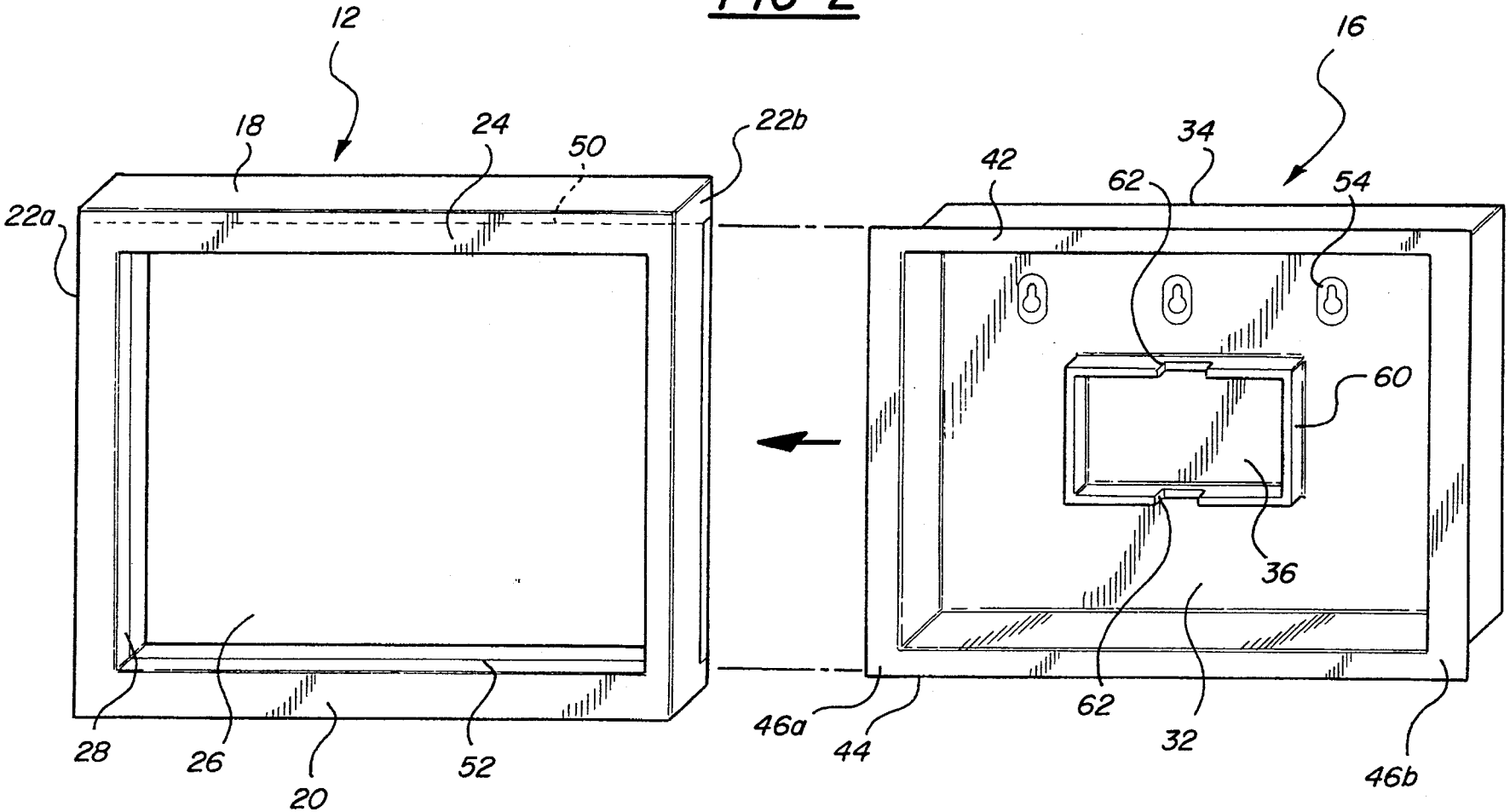
FIG. 2 is a perspective view of an embodiment of the present invention with the frame backing member aligned for insertion within the front frame member.

Referring now to the drawings and, in particular, to FIGS. 1 and 2, there is depicted a cassette display frame 10 having a front frame member 12 and a frame backing member 16. In general, a cassette 3 is secured to the frame backing member 16 and the frame backing member 16 is then inserted in or otherwise attached to the front frame member 12 of the cassette display frame 10 to display the cassette 3.

The front frame member 12 of the cassette display frame 10 has a top portion 18, a bottom portion 20, and two opposed side portions 22*a*,22*b* joined together to form a frame 24 around a cassette-viewing opening 26. The top portion 18, bottom portion 20, and side portions 22*a*,22*b* of the front frame member 12 further define a cavity 28 which has a depth at least sufficient to contain a cassette therein. The depth of the cavity 28 is represented in FIG. 1 by the line marked D—D.

A transparent panel 14 is positioned over the cassette-viewing opening 26 within the cavity 28 and secured therein. Preferably, the transparent panel 14 is glass, but other transparent materials such as sheets of clear plastic may also be used. As best shown in FIG. 1, the transparent panel 14 allows the cassette 3 to be visible when the display frame 10 is viewed from the front while simultaneously protecting the cassette 3 from dust and other contaminants.

Figure 5A:
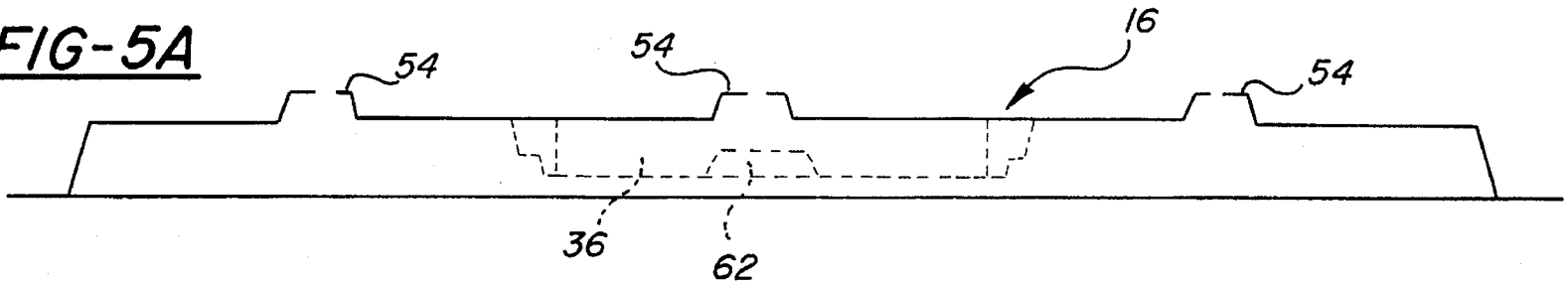
FIG. 5A is a top view.
Figure 5C:
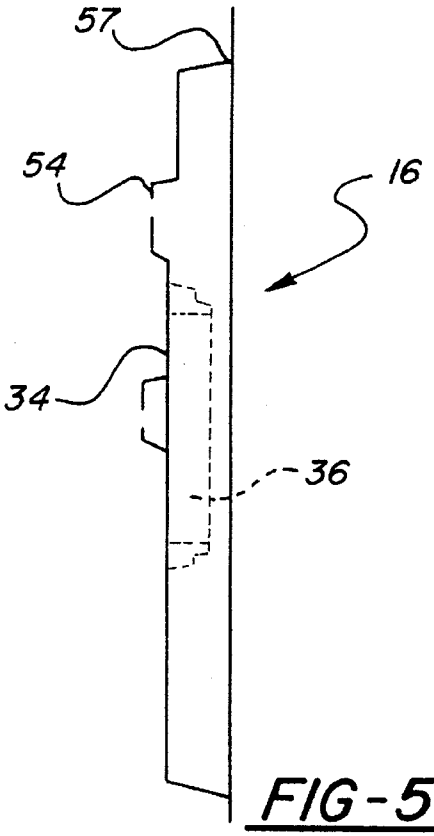
FIG. 5C is a side view of a frame backing member of the present invention.
Figure 5B:
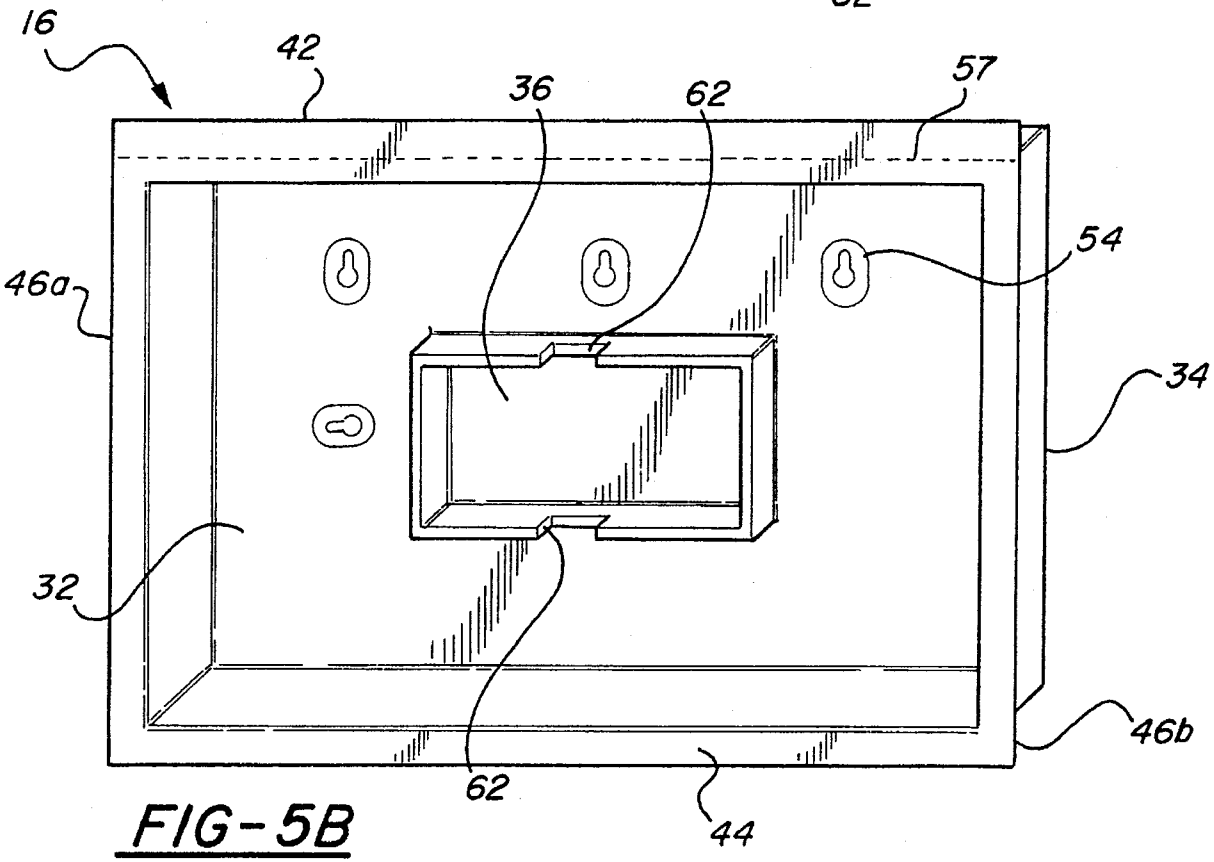
FIG. 5B is a front perspective view.

The frame backing member 16 has a front surface 32, a back surface 34, a top edge 42, a bottom edge 44, and two opposed side edges 46*a*,46*b*. The frame backing member 16 further has a cassette retention means 36 to releasably hold a cassette 3 in place on the front surface 32 of the frame backing member 16 such that the cassette 3 is visible through the cassette-viewing opening 26 (see FIGS. 5A, 5B and 5C). The cassette retention means 36 preferably comprises a tray 60 protruding from the front surface 32 of the frame backing member 16, said tray protrusion 60 having dimensions sufficient to snugly surround the perimeter of a cassette. Alternatively, the cassette retention means 36 may comprise a cassette-sized indentation in the front surface 32 of the frame backing member 16. Although shown centered in the figures, the cassette retention means 36 may be positioned at alternative locations on the front surface 32 of the frame backing member 16 in any aesthetically-pleasing manner. Optionally, the cassette retention means 36 may further include finger notches 62 to assist in the removal of the cassette 3 from the frame backing member 16.

Figure 3B:
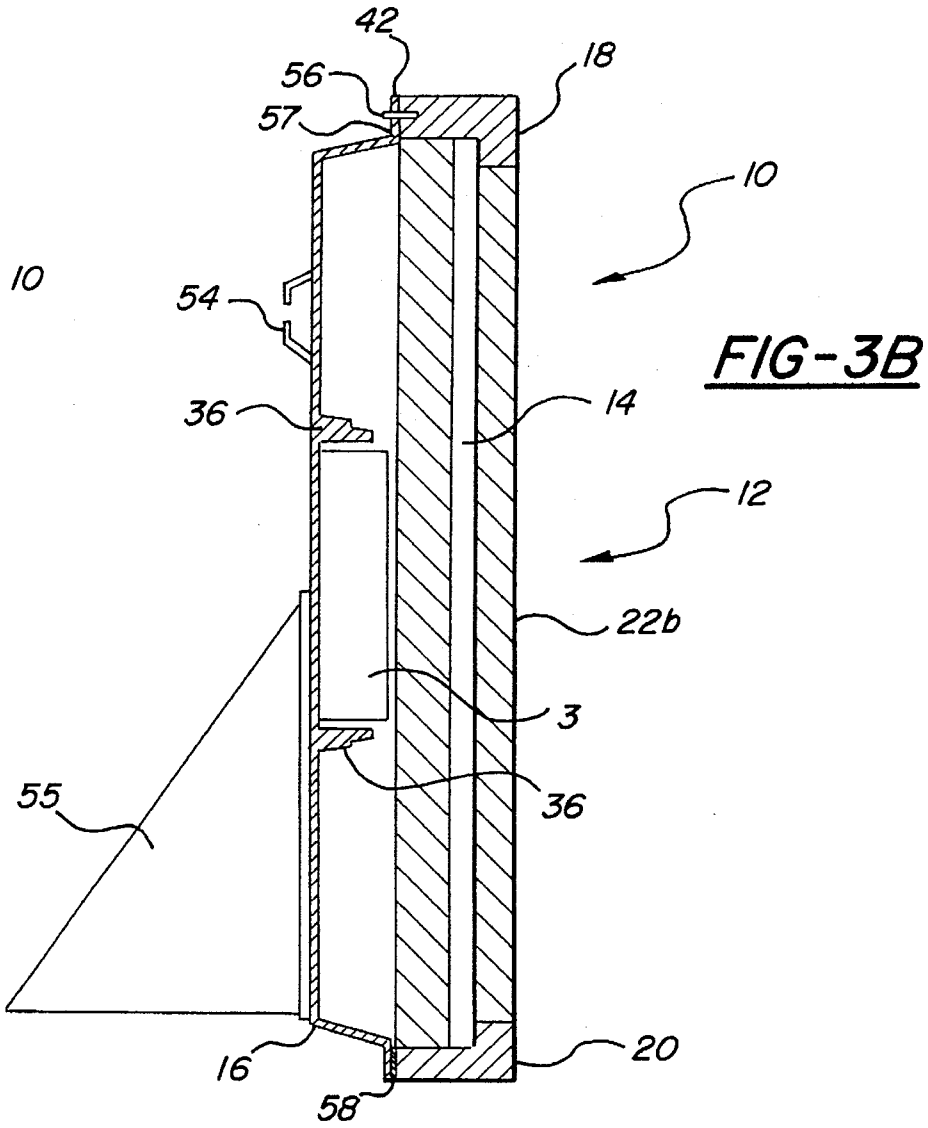
FIG. 3B is a cut-away side view of the front frame member and the frame backing member in an alternative embodiment of the present invention.
Figure 3A:
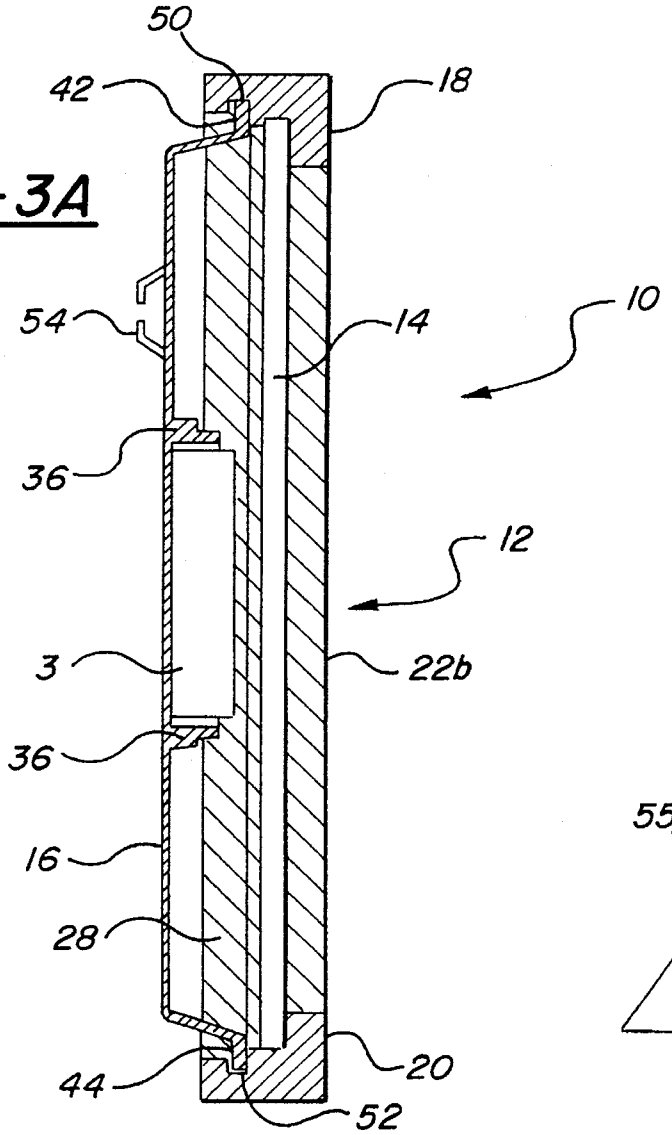
FIG. 3A is a cut-away side view of the front frame member and the frame backing member in an embodiment of the present invention.

As best shown in FIG. 2 and FIG. 3A, in one embodiment of the cassette display frame 10, the frame backing member 16 is slidably positioned and secured within the cavity 28 of the front frame member 12 behind the transparent panel 14.

More particularly, in this embodiment, the cassette display frame 10 has a first groove 50 in the top portion 18 of the front frame member 12 and a second groove 52 in the bottom portion 20 of the front frame member 12. The first groove 50 and the second groove 52 are directly opposite one another in the cavity 28 of the front frame portion 12. The frame backing member 16 is slidably positioned and secured within the cavity 28 of the front frame member 12 by simultaneously inserting the top edge 42 of the frame backing member 16 into the first groove 50 and the bottom edge 44 of the frame backing member 16 into the second groove 52 and sliding the frame backing member 16 in the grooves 50, 52 in the front frame member 12 similar to the way that a photograph is inserted into a conventional picture frame.

Figure 4B:
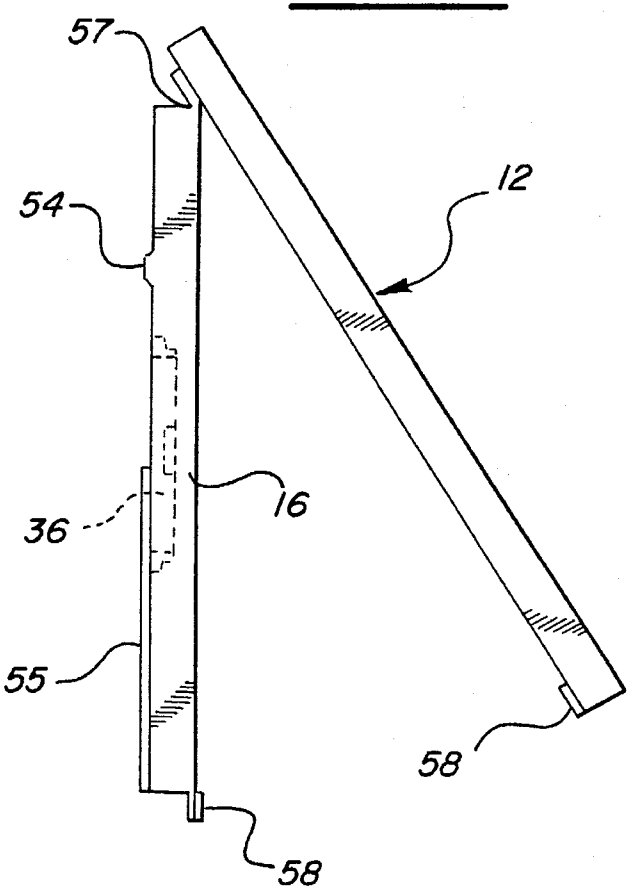
FIG. 4A is a rear view and FIG. 4B is a side view of an alternate embodiment of the present invention.
Figure 4A:
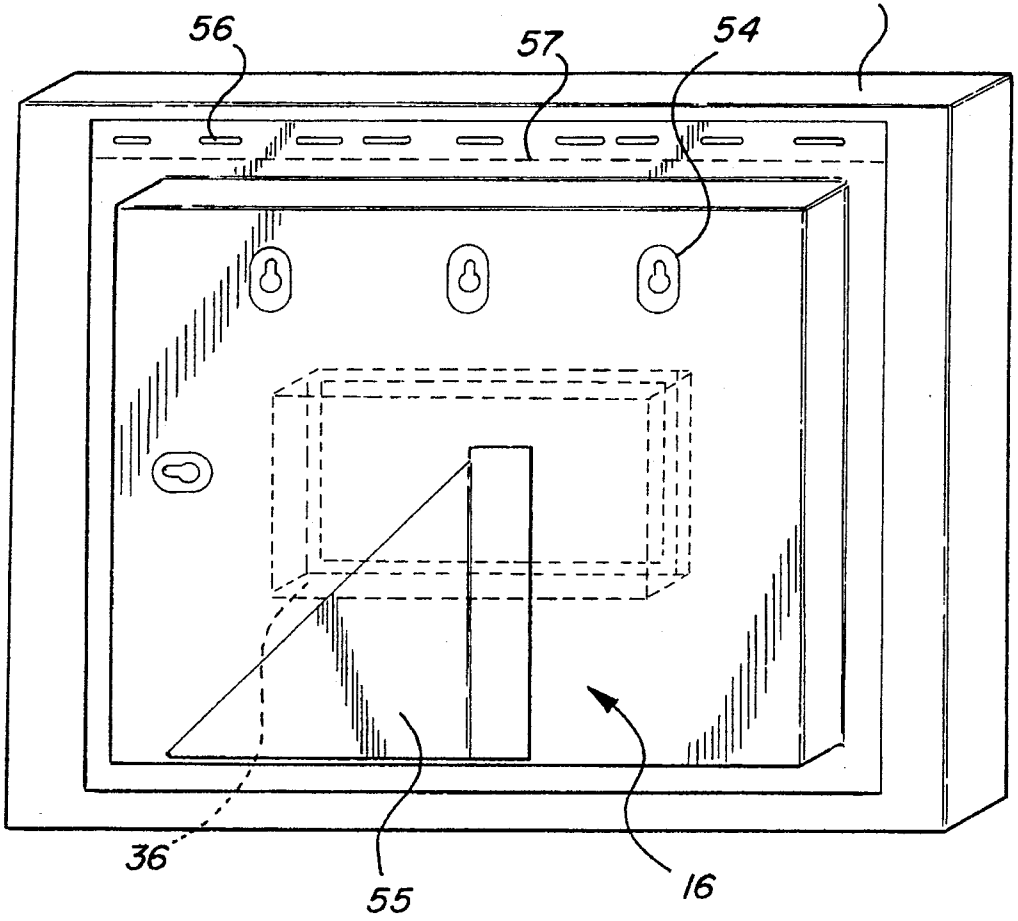
Figure 6:
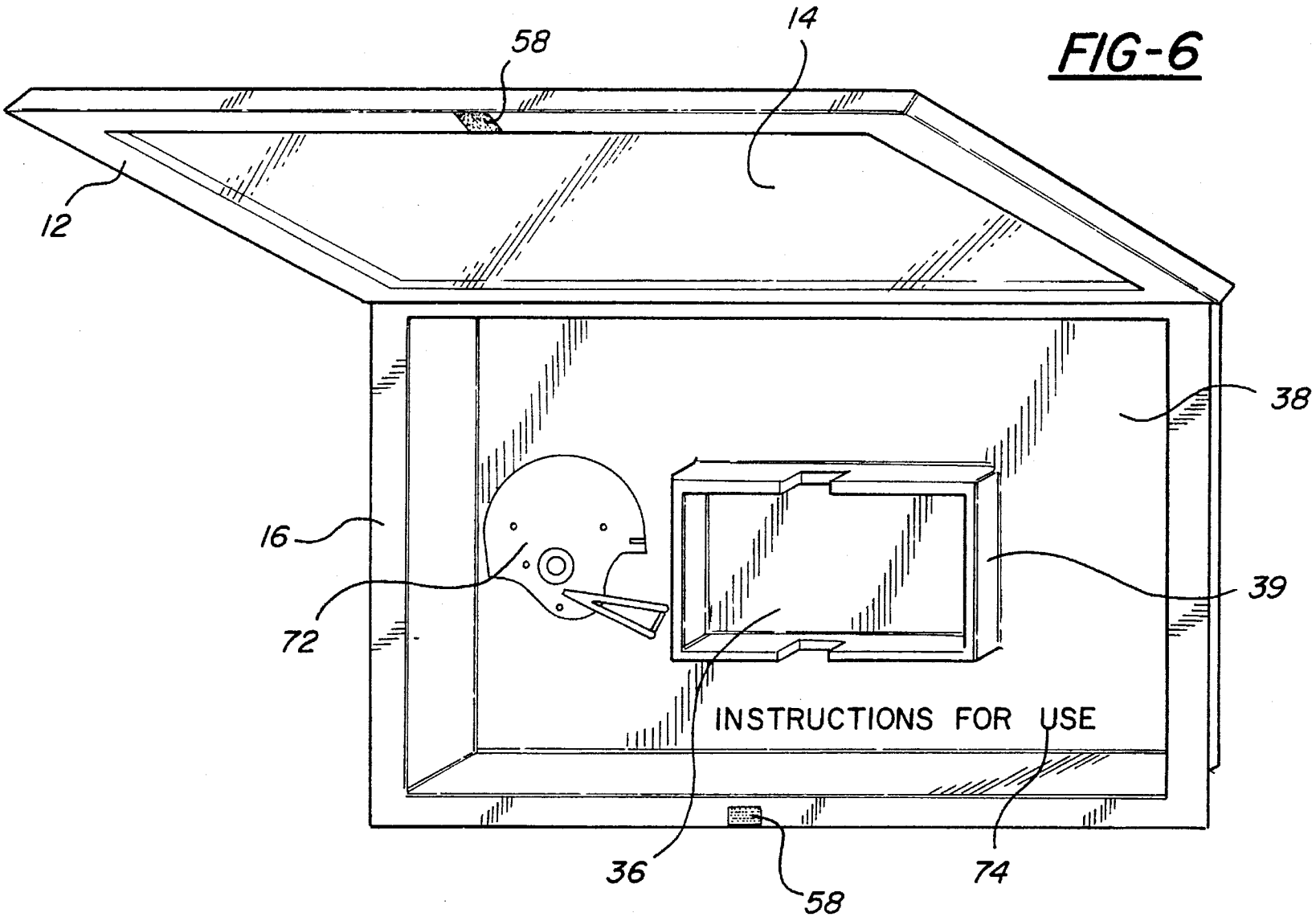
FIG. 6 is a front perspective view of an alternative embodiment of the present invention.

In an alternative embodiment, best shown in FIG. 3B and FIGS. 4A and 4B, the top edge 42 of the frame backing member 16 is secured to the front frame member 12 using fastening means 56 such as staples or screws. A crease 57 extends the length of the top edge 42 beneath the fastening means 56 and creates a hinge-like connection between the front frame member 12 and the frame backing member 16. In this alternative embodiment, a releasable securement means 58 such as Velcro is optionally affixed to the bottom edge 44 of the frame backing member 16 and the bottom portion 20 of the front frame member 12 to hold the front frame member 12 and the frame backing member 16 together when the frame 10 is in use, but also to allow easy access to the cassette retention means 36 to remove or replace the cassette. An alternative embodiment of the cassette display frame 10 having a hinge-like connection between the front frame member 12 and the frame backing member 16 is shown in FIG. 6.

In addition, the cassette display frame 10 may further include a first mat 38 positioned between the front surface 32 of the frame backing member 16 and the transparent panel 14 of the front frame member 12. The first mat 38 has a cassette-sized aperture 39 therethrough to correspond to the location of the cassette retention means 36 such that when a cassette is held in place by the cassette retention means 36, the aperture 39 closely surrounds the perimeter of the cassette. In addition to or instead of first mat 38, a second mat 40 defining a border around said cassette-viewing opening 26 may be positioned between the front surface 32 of the frame backing member 16 and the transparent panel 14 of the front frame member 12. In embodiments including a first mat 38, second mat 40 is positioned between the first mat 38 and the transparent panel 14. First mat 38 and second mat 40 may be a variety of different colors and designs to increase the aesthetic appeal of the cassette display frame 10. Preferably, first mat 38 or second mat 40 may also convey a written message 70 or other visual identification 72 such as photographs or drawings which relate to the content of the cassette displayed within the cassette display frame 10. For example, if the cassette display frame 10 contains a video cassette 3 of a wedding, first mat 38 may be customized to include the names of the bride and groom and the wedding date and to further include a photograph of the happy couple. As another example, if the cassette display frame 10 contains a video cassette 3 or an audio cassette 5 of an important lecture or sermon, the first mat 38 may be customized to include the name of the speaker, the title of the lecture or sermon, and instructions 74 as to the optimal circumstances for removing the cassette from the frame 10 for viewing or listening.

Optionally, the cassette display frame 10 may further include a wall-hanging means 54 affixed to or integrally formed in the back surface 34 of the frame backing member 16. The wall-hanging means 54 may be a conventional hook of the type used to hang pictures or it may be an aperture through a portion of the frame backing member 16 for the insertion of a nail or other hanging appliance. Alternatively or in addition to the wall hanging means 54, a table-top support means 55 may also be affixed to the back surface 34 of the frame backing member 16 so that the cassette display frame 10 may be propped up on a table top or other flat surface.

Thus it is apparent that there has been provided, in accordance with the invention, a cassette display frame 10. While the invention has been described in conjunction with specific embodiments thereof, it is evident that many alternatives, modifications, and variations will be apparent to those skilled in the art in light of the foregoing description. For example, although only video cassettes are shown in the drawings, it should be understood that throughout this specification and in the claims, the term "cassette" shall encompass video cassettes, audio cassettes, compact discs, and the like without departing from the spirit of the present invention. Accordingly, the present invention is intended to embrace all such alternatives, modifications, and variations as falling within the spirit and broad scope of the claims.

I therefore claim:

1. A cassette display frame comprising:

a front frame member having a top portion, a bottom portion, and two opposed side portions joined together to form a frame around a cassette-viewing opening, said front frame member further defining a cavity, said cavity having a depth at least sufficient to contain a cassette therein;

a transparent panel positioned over said cassette-viewing opening within said cavity;

a frame backing member having a front surface, a back surface, a top edge, a bottom edge, and two opposed side edges;

fastening means to hold said frame backing member to said front frame member in a joined relationship when said frame backing member and said front frame member are in alignment;

a cassette; and a cassette retention means to releasably hold said cassette in place on said front surface of said frame backing member such that when said front frame member and said frame backing member are fastened together said cassette is visible through said cassette-viewing opening without contacting said transparent panel.

2. The cassette display frame of claim 1 further comprising a first mat positioned between the front surface of the frame backing member and the transparent panel of the front frame member, said first mat having a cassette-sized aperture therethrough to correspond to the location of the cassette retention means such that when a cassette is held in place by the cassette retention means, said aperture closely surrounds the perimeter of the cassette.

3. The cassette display frame of claim 2 wherein said first mat further includes a picture which relates to the content of the cassette displayed in said cassette retention means.

4. The cassette display frame of claim 1 wherein said first mat further includes a written readable message which relates to the content of the cassette displayed in said cassette retention means.

5. The cassette display frame of claim 4 wherein said written readable message is instructions for when to remove the cassette from the frame for use.

6. The cassette display frame of claim 1 further comprising a second mat positioned between the front surface of the frame backing member and the transparent panel of the front frame member, said second mat defining a border around said cassette-viewing opening.

7. The cassette display frame of claim 1 further comprising a wall-hanging means on the back surface of the frame backing member.

8. The cassette display frame of claim 1 further comprising a table-top support means affixed to the back surface of the frame backing member.

* * * * *